United States Patent [19]

Woodard

[11] 4,275,474

[45] Jun. 30, 1981

[54] VACUUM HEAD FOR SWIMMING POOL CLEANING SYSTEM

[76] Inventor: Randle C. Woodard, 20751 Prairie St., Chatsworth, Calif. 91311

[21] Appl. No.: 34,298

[22] Filed: Apr. 30, 1979

[51] Int. Cl.[3] ..... E04H 3/20

[52] U.S. Cl. ..... 15/1.7; 15/421

[58] Field of Search ..... 15/1.7, 321, 322, 339, 15/353, 357, 399, 400, 401, 414, 419, 421

[56] References Cited

U.S. PATENT DOCUMENTS

| | | | |
|---|---|---|---|
| 953,825 | 4/1910 | Gekeler | 15/421 |
| 2,295,817 | 9/1942 | Winther | 15/421 X |
| 2,452,612 | 11/1948 | Swenberg | 15/421 X |
| 2,648,396 | 8/1953 | Kirby | 15/421 X |
| 3,008,160 | 11/1961 | West | 15/1.7 |
| 3,039,122 | 6/1962 | Birdsall | 15/353 X |
| 3,820,189 | 6/1974 | Roth | 15/400 |
| 3,994,042 | 11/1976 | Zakis | 15/339 |
| 4,053,962 | 10/1977 | McDowell | 15/415 R |

FOREIGN PATENT DOCUMENTS

| | | | |
|---|---|---|---|
| 137078 | 5/1950 | Australia | 15/421 |
| 875332 | 8/1961 | United Kingdom | 15/421 |

*Primary Examiner*—Edward L. Roberts
*Attorney, Agent, or Firm*—Matthew P. Lynch

[57] ABSTRACT

Provided is a vacuum head for a swimming pool cleaning system, the head being of the bristle-type for use particularly on vinyl liners, and the like, and comprising a wide, substantially shallow structure including an elongated top, walls and an outlet oriented upwardly from the top and communicating with the generally hollow interior of the head, the upright outlet forming a first connection for attachment of a vacuum hose to the head. A second hose of a diameter smaller than that of the first hose may be detachably positioned over an adapter member which is removably fitted within the first hose connection. Suction control in the form of at least one water by-pass valve is provided in the head top, enabling water sucked into the head interior to be selectively released therefrom, thereby preventing an excessively high suction force in the head intake area and such a force resulting from too great a build-up of vacuum within the cleaning system. Fixedly secured to the head top inner surface are a pair of axially opposed stabilizing weights and a connection for attachment of a handle or pole is provided at the top outer surface.

10 Claims, 8 Drawing Figures

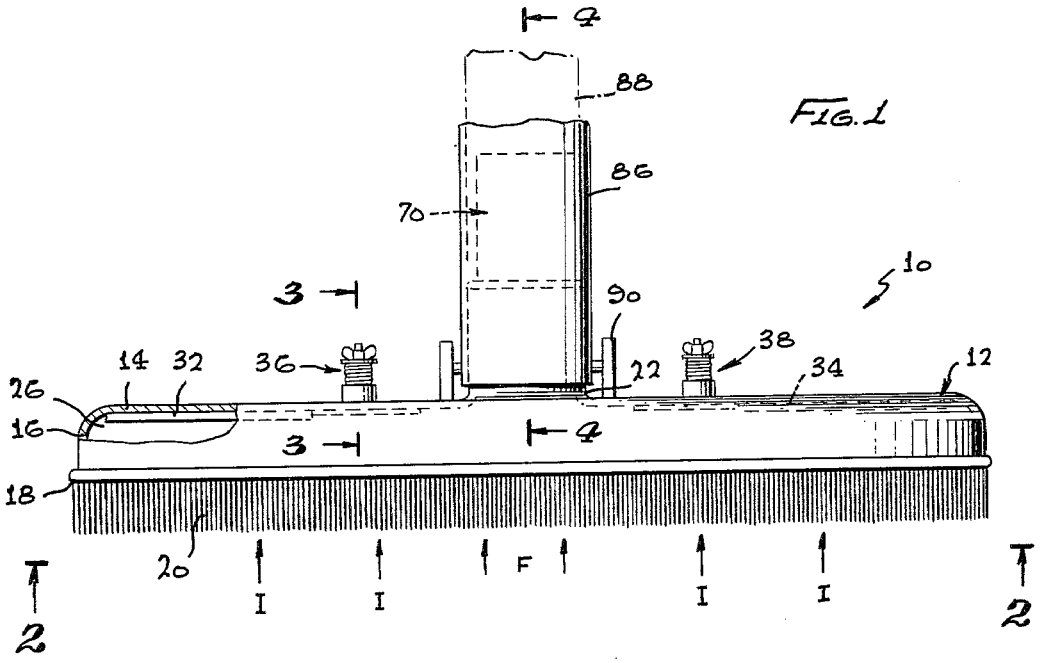
FIG. 1
FIG. 2
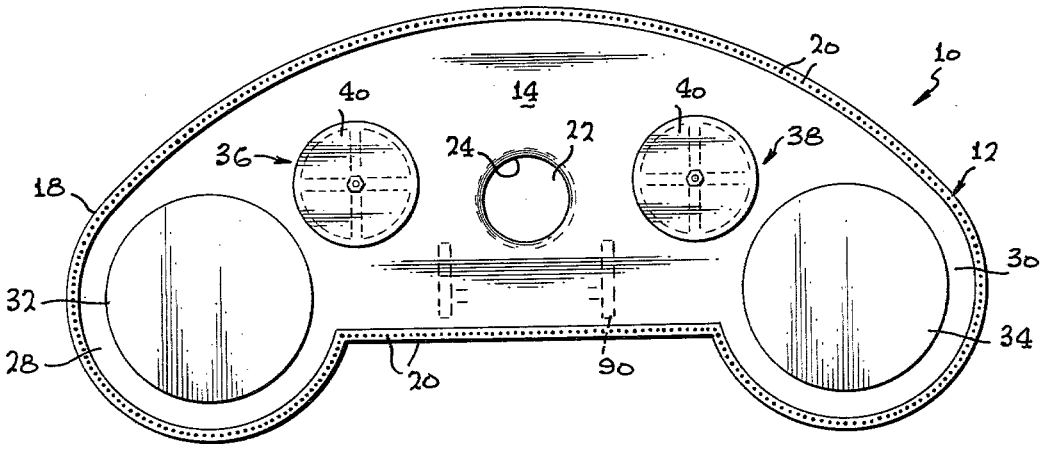
FIG. 3
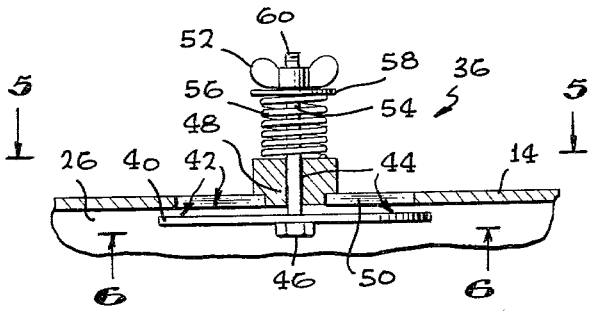
FIG. 7
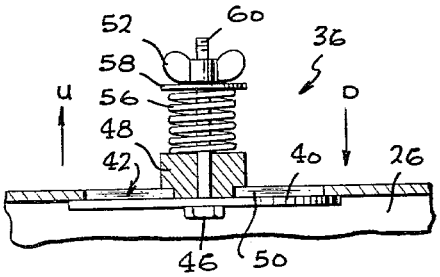

FIG. 3a
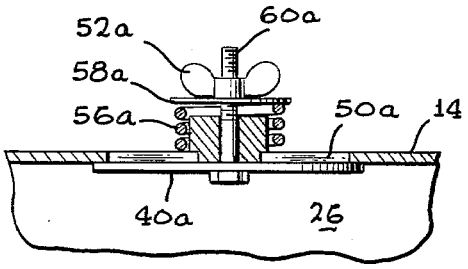
FIG. 5
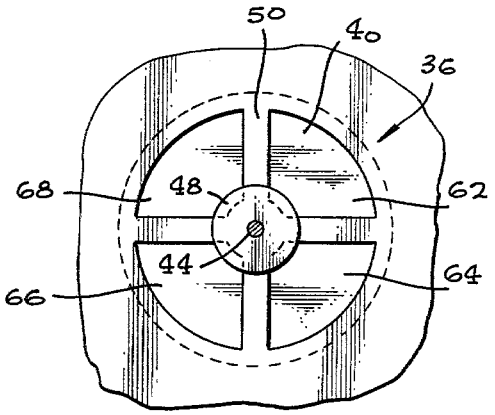
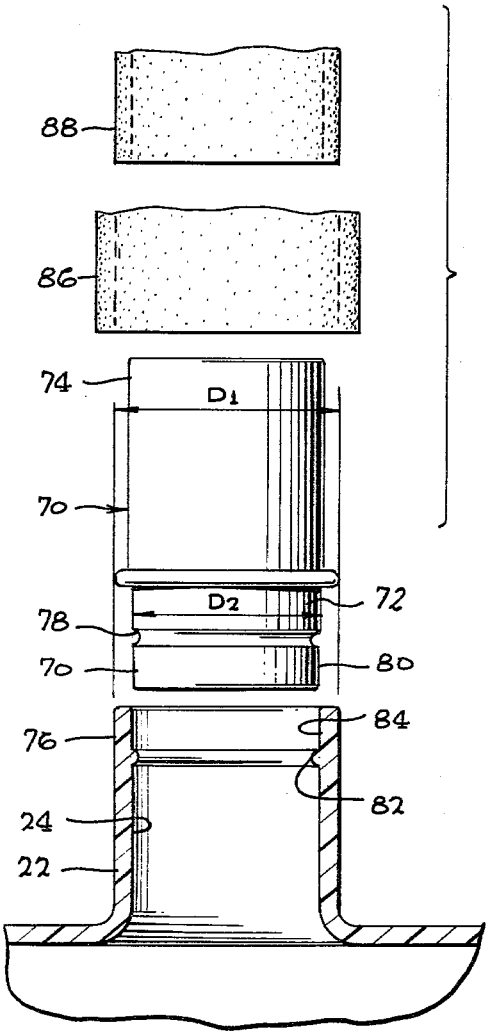
FIG. 4
FIG. 6
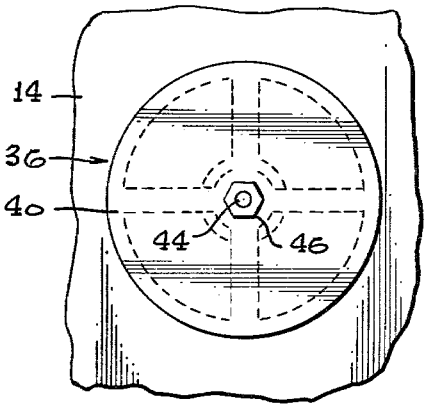

VACUUM HEAD FOR SWIMMING POOL CLEANING SYSTEM

BACKGROUND OF THE INVENTION

1. Field of the Invention

The present invention, in general, relates to a cleaning implement for swimming pools and, more in particular, relates to an improved vacuum cleaning head for use particularly on vinyl walls, and the like, the head incorporating the novel features of suction control and adapter means for attachment of differently by-sized vacuum hoses to the vacuum head.

2. The Prior Art

Widely known and commonly used for swimming pool cleaning applications, specifically vacuum-operated ones, are the so-called vacuum heads which, in practice, are interconnected with the vacuum systems via a vacuum hose. In operation, these cleaning implements are slowly moved over a swimming pool wall to sweep or vacuum the same. Typically, a great variety of differently-sized and-shaped vacuum heads are available. For example, particularly for use on concrete-type swimming pool walls are vacuum heads designed for a "rolling" motion provided by roller members disposed at the lower surface of the head. In another instance, vacuum heads have been designed particularly for sweeping swimming pools with vinyl liners. This type of vacuum head, typically, is formed with a circumferentially disposed bristle formation which, in operation, rests upon the pool wall and which, during motion of the head over the wall agitates solids, and the like, in the head intake area. Although this latter type of vacuum head is most satisfactory, they lack any provision for suction control, i.e., the ability to enable water sucked into the vacuum head interior to be selectively released therefrom, thereby to prevent an excessively high suction force in the head intake area, such force being created by too high a build-up of vacuum within the cleaning system. Desired control of the suction force, inter alia, eliminates damage to the swimming pool wall, e.g., ripping of the vinyl liner, and also possible collapse of the bristles of the vacuum head. Another disadvantage encountered with hitherto-known type vacuum heads lie in the fact that they lack any sort of ability to facilitate attachment of differently-sized vacuum hoses to the vacuum head.

SUMMARY OF THE INVENTION

Object of the present invention is to provide an improved vacuum head which is devoid of the aforementioned disadvantages and which incorporates such novel features as suction control and ability to facilitate attachment of differently-sized vacuum hoses to the vacuum head.

Further object of the invention is to provide such an improved vacuum head for swimming pool cleaning applications which is simple in construction, economic to manufacture and easy to operate.

Accordingly, the vacuum head embodying the present invention comprises a flat-shaped housing having an elongated top, walls and an outlet formed at the top, the outlet having a diameter such as to enable attachment of a first hose to the vacuum head. To enable attachment of a vacuum hose of a diameter smaller than the first one, an adapter member is provided and which may be selectively fitted within the outlet. Suction control in the form of at least one water by-pass valve is provided in the head top, enabling water sucked into the head interior to be slectively released therefrom, thereby to prevent an excessively high suction force in the head intake area. Bristles are disposed circumferentially along the head lower surface while a handle or pole attachment is fixed to the upper head top exterior.

These together with other objects and advantages which will become subsequently apparent reside in the details of construction and operation as more fully hereinafter described and claimed, reference being had to the accompanying drawings forming a part hereof, and wherein:

BRIEF DESCRIPTION OF THE DRAWINGS

FIG. 1 is a perspective front view of a vacuum head for a swimming pool cleaning system, embodying the present invention;

FIG. 2 is a transverse sectional view of the vacuum head assembly taken sustantially through a plane indicated by section line 2—2 in FIG. 1;

FIG. 3 is an enlarged sectional view taken substantially through a plane indicated by section line 3—3 in FIG. 1, the view illustrating a suction control valve incorporated in the vacuum head assembly;

FIG. 3*a* is a view similar to FIG. 3, but of a modified form of suction control valve;

FIG. 4 is an enlarged sectional view taken substantially through the plane 4—4 in FIG. 1, illustrating the vacuum hose adapter assembly according to the invention;

FIG. 5 is a top sectional view taken on line 5—5 of FIG. 3, illustrating the valve by-pass opening and associated valve closure member of the suction control valve assemble of FIG. 3;

FIG. 6 is a sectional view taken on line 6—6 of FIG. 3, illustrating the arrangement of FIG. 5 as viewed from the bottom of suction control valve; and FIG. 7 is a side cross-sectional view taken on line 7—7 of FIG. 5, illustrating the spring-actuated valve closure member moved to its upper, closed and lower, open portion.

DESCRIPTION OF THE PREFERRED EMBODIMENT

Referring now to the drawings in which like reference numerals index like parts and with attention initially directed to FIGS. 1 and 2, there is shown a vacuum head assembly generally referred to by reference numeral 10. Head assembly 10 is seen to comprise a housing or shell 12 of a generally flat configuration and which includes a wide and elongated upper wall 14, side walls 16 and a rim 18 which bounds the walls 16. Upper wall 14 extends substantially horizontally with respect to the perpendicular walls 16. In the illustration shown in FIG. 2, the structure 10 may be considered as being substantially shell-shaped in transverse cross-sectional views. Embedded within and directed downwardly from rim 18 is the formation of circumferentially disposed bristles 20. The bristles 20, as hereinbefore discussed, serve to agitate solids, and like materials, resting on the swimming pool walls. Bristles 20, typically, are of a stiff nature and may be made of any suitable plastic material. The bristles should possess a stiffness such as to suitably support and carry the housing or frame 12. Disposed generally centrally of the flat top 14 is a spout-shaped outlet 22. Outlet 22 is generally upwardly directed from the wall 14 and has an inner opening 24 of a predetermined diameter. As will be appreciated, opening 24 communicates with the generally hollow interior 26 of housing 12. Disposed at generally opposite ends 28, 30 of housing 12 are a pair of stabilizing weights 32, 34, respectively. Axially opposed weights 32, 34 may be of any suitable configuration as, for example, circular and should be positioned such as to provide positive stabilization of vacuum head 10 on the swimming pool walls (not shown), particularly on an incline of such walls. They may be made of any suitable material as, for instance, a metal. Provided in the wall 14 are suction controls 36, 38 which, in the embodiment shown, are disposed practically directly laterally of outlet 22. Typically, suction controls 36, 38 are in the form of water by-pass valves or relief valves provided in head top 14 and which enable water sucked into head interior 26 from a direction I or intake, FIG. 1, to be selectively released therefrom, thereby to prevent an excessively high suction force F, FIG. 1, in the head intake area. Such a force F, typically, results from too great a build-up of vacuum within the cleaning system, i.e., between a filter pump, not shown, and the vacuum head. The positioning of control valves 36, 38 directly adjacent outlet 22 ensures a positive, quick release of water from vacuum head 10 and thereby, simultaneously, a quick reduction in suction within the head and head intake area.

As particularly shown in FIGS. 3 and 5–6, the water by-pass valves or relief valves 36, 38 of FIG. 1, each are comprised of a closure member in the form of an annular plate 40 which enables desired opening and closing of a vent 42 which serves as a opening or secondary outlet for the release of water from head interior 26. Opening and closing of vent 42, in the embodiment shown, is effected by plate 40 by turning of a screw member 44, the latter being fixedly attached, at its lower end 46, to plate 40. Lower end 46 of screw member 44 may, as shown in the attachment of FIG. 6, be in the form of a so-called hexnut. The turning of screw member 44 relative to vent 42 is effected by an annular, inner stub 48. Stub 48, as best shown in FIGS. 5 and 6, is formed integrally with and supported by a branch network 50 which bridges the vent 42. Stub 48, as shown, is directed upwardly from head top 14. Turning of screw member 44 is facilitated by a wing nut 52 at the upper end 54 of screw 44. Turning of screw member 44 is further facilitated by the bias of a pressure spring 56 disposed intermediate a washer 58 and the uppermost end 60 of stub 48. In the manner shown in FIG. 7 in which the plate 40 is placed respectively in its upper closed and lower open position, clockwise turning of wing nut 52 forces screw member 44 in upward direction, arrow U, while counter clockwise turning of wing nut 52 forces the member 44 to be displaced to a lower position relative to stub 48, arrow D. The provision of branch network 50 across vent 42, as shown best in FIG. 5, provides a plurality of water flow passages 62–68 in the head top 14.

FIG. 3*a* shows a modified form of suction valve. In this arrangement, actuation of plate member 40*a* is effected solely by the bias or the release of bias of a spring 56*a*, the latter being held in position between a washer 58*a* and the network 50*a*. In all other respects, operation of the valve of FIG. 3*a* is identical to that of the one shown in FIGS. 3 and 5–7.

The opening 24 of outlet 22 has an inner diameter such as to enable a vacuum hose adapter member 70 to be snugly fitted within the opening 24 of outlet 22. To this end, adapter 70 has a lower end 72 of a diameter smaller than its upper end 74. Lower end 72 is snap fitted within the upper end 76 of outlet opening 24. This is effected by a peripheral groove 78 on the outer periphery 80 of adapter 70 and an inner ridge 82 provided in the inner periphery 84 of outlet 24. In positioning adapter 70 within the upper end 76 of outlet opening 24, the ridge 82 of outlet 22 is snapped into position within the annular confines of groove 78.

In this manner a first outer diameter $D_1$, is determined by the outer periphery of outlet 22 while a second smaller outer diameter $D_2$ is determined by the outer periphery of the lower end 72 of adapter 70. As a result, a vacuum hose 86, FIG. 1, having an inner diameter corresponding to that of outer diameter $D_1$, of outlet 22 may be removable attached to vacuum head 10. A second vacuum hose 88 having an inner diameter corresponding to that of outer diameter $D_2$ of adapter 70 may be removably engaged over the upper end 74 of adapter 70. In this manner, an adapter is provided which enables the attachment of vacuum hoses of differently-sized coupling diameter to vacuum head 10.

A handle or pole coupling 90, FIGS. 1 and 2, is provided for attachment of a handle or pole (not shown) to the vacuum head. Typically, the coupling is positioned on the flat top 14, rearwardly of outlet 22 to facilitate maneuvering with the pole relative to a connected vacuum hose.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is:

1. A vacuum head for a swimming pool cleaning system, said vacuum head having a head intake area, said vacuum head comprising:

a housing located about said head intake area, said housing having an upper wall;

outlet means formed in said upper wall;

first and second vacuum hose connector means associated with said outlet means for attachment of differently-sized vacuum hoses to said vacuum head, said second hose connector means including a hose adapter snap-fitted into said first hose connector means and having a hose connecting diameter smaller than the last-mentioned connector means;

vacuum control means formed in said upper wall for preventing an excessively high water suction force in said head intake area resulting from too great a vacuum build-up, said vacuum control means being in the form of at least one water by-pass valve for regulating the suction within said head intake area, said valve including a closure member associated with a water vent in said upper wall, and an axially adjustably positionable stem member for maintaining said closure member in a closed position relative to said vent, thereby selectively controlling the extent of water flow into said vacuum head; and means for attachment of handle means to said vacuum head.

2. The system of claim 1, wherein said first hose connector means is defined by the spout of said outlet means.

3. The system of claim 2, wherein said spout is oriented upwardly from said wall, and further comprising locking means for detachably retaining said adapter member in said spout.

4. The system of claim 3, wherein said locking means is in the form of an internal ridge on said adapter member and an internal groove in said spout.

5. The system of claim 1, wherein said water by-pass valve further comprises a pressure spring associated with said stem member and said spring tending to maintain said closure member in the position closing said water vent.

6. The system of claim 5, wherein said water by-pass valve further comprises a web bridging said water vent and wherein said pressure spring for said stem member is associated with a washer and hub member for retaining said spring in position, said hub member being supported by and secured to said web, generally centrally of said water vent.

7. The system of claim 6, wherein said stem member is a screw member turnable in said hub member and axially displaceable relative thereto by a wing nut.

8. The system of claim 7, wherein said screw member is a hexnut and said closure member is of annular plate-shaped configuration.

9. The system of claim 8, wherein there being a plurality of said water by-pass valves which are positioned in flanked relation relative to said outlet means.

10. The system of claim 6, wherein said vent is of annular configuration and said web extends crosswise over said vent, said web defining a plurality of openings extending radially outwardly from said hub member.

* * * * *